US011179826B2

(12) United States Patent
Suzuki

(10) Patent No.: US 11,179,826 B2
(45) Date of Patent: Nov. 23, 2021

(54) SHOT TREATMENT APPARATUS AND SHOT TREATMENT METHOD

(71) Applicant: SINTOKOGIO, LTD., Nagoya (JP)

(72) Inventor: Yukinori Suzuki, Toyokawa (JP)

(73) Assignee: SINTOKOGIO, LTD., Nagoya (JP)

( * ) Notice: Subject to any disclaimer, the term of this patent is extended or adjusted under 35 U.S.C. 154(b) by 0 days.

(21) Appl. No.: 16/874,850

(22) Filed: May 15, 2020

(65) Prior Publication Data

US 2020/0398401 A1 Dec. 24, 2020

(30) Foreign Application Priority Data

Jun. 18, 2019 (JP) ..... JP2019-112641

(51) Int. Cl.
*B24C 1/10* (2006.01)

(52) U.S. Cl.
CPC ..... *B24C 1/10* (2013.01)

(58) Field of Classification Search
CPC .... B24C 1/10; B24C 3/00; B24C 5/04; B24C 7/0046
See application file for complete search history.

(56) References Cited

U.S. PATENT DOCUMENTS 6,371,839 B2 * 4/2002 Izawa ..... B24C 7/0046 451/88
2019/0047119 A1 * 2/2019 Krehbiel ..... B24C 1/10

FOREIGN PATENT DOCUMENTS

JP H09-248762 A 9/1997

* cited by examiner

*Primary Examiner* — Ryan J. Walters
(74) *Attorney, Agent, or Firm* — Oliff PLC

(57) ABSTRACT

A shot treatment apparatus and a shot treatment method that can efficiently detect operational abnormalities and signs of operational abnormalities, and that can further take countermeasures based on the detected signs of operational abnormalities. This shot treatment apparatus is provided with a storage portion, a nozzle, a transport path, a compressed-air supply portion, a negative pressure gauge, an abnormality detection unit, an abnormality response unit, and a control unit. Shot material is transported to the nozzle by negative pressure generated in the interior of the nozzle. The negative pressure gauge is disposed on the transport path by which the shot material is transported. The abnormality detection unit detects "operational abnormalities" and "signs of operational abnormalities" based on detection results from the negative pressure gauge. The abnormality response unit operates based on the detection results from the abnormality detection unit. The control unit controls the operations of this abnormality response unit.

8 Claims, 6 Drawing Sheets

SHOT TREATMENT APPARATUS AND SHOT TREATMENT METHOD

TECHNICAL FIELD

The present invention relates to a shot treatment apparatus and a shot treatment method.

BACKGROUND

Shot treatment apparatuses are widely known as being apparatuses for surface treatment, such as by blasting or shot peening, by ejecting a solid-gas two-phase flow, in which a shot material has been mixed into a high-pressure gas flow, from an ejection nozzle towards a treatment target.

These shot treatment apparatuses include a type in which the shot material is pumped into a path from a compressed-air supply portion to a nozzle, mixed with compressed air, and ejected as a solid-gas two-phase flow (direct-pressure type), and a type in which the shot material is sucked into a nozzle interior by a negative pressure generated in the nozzle interior, mixed with compressed air, and ejected as a solid-gas two-phase flow (suction type).

In suction-type shot treatment apparatuses, negative pressure is generated inside the nozzle by means of the Venturi effect, and this negative pressure sucks the shot material to the nozzle.

When the shot material is transported by negative pressure, the pressure applied to the shot material is weaker than that in the direct-pressure type. Therefore, there is a risk that a hose will become clogged, depending on the state of the shot material that is used or the like.

Additionally, there is a risk that the shot material will scrape away the inner surface of the hose due to long-term usage of the apparatus, causing the hose to tear, or causing the hose to come loose from the nozzle and causing the mouth of the hose to open while the apparatus is operating, making normal treatments by means of the shot material impossible.

Patent Document 1 discloses a gear reinforcing apparatus wherein a negative pressure gauge is provided at the outlet of a hopper, and the negative pressure gauge is observed to detect abnormalities in a path along which glass beads are transported from the hopper to a nozzle.

CITATION LIST

Patent Literature

Patent Document 1: JP H9-248762 A

SUMMARY OF INVENTION

Technical Problem

In the apparatus described in Patent Document 1, abnormalities are detected based only on whether or not the negative pressure gauge indicates a normal value. Thus, the location at which an abnormality has occurred and the state of the abnormality cannot be identified. For this reason, there is a risk that a lot of time will be required for recovery.

Additionally, if the state of the apparatus changes over time and begins to leave the normal state, there will be variation in the level of treatment by the shot material. Furthermore, if the treatment is continued, then the apparatus will malfunction. For this reason, if a tendency for the state of the apparatus to leave the normal state can be recognized, then maintenance can be performed in advance, thereby preventing abnormalities before they occur. However, the apparatus described in Patent Document 1 does not have such a function.

The present invention was made in consideration of such problems. The problem to be solved by the present invention is to provide a shot treatment apparatus and a shot treatment method that can efficiently detect operational abnormalities and signs of operational abnormalities, and that can further take countermeasures based on the detected signs of operational abnormalities.

Solution to Problem

The present invention employs the means indicated below in order to solve the above-mentioned problem.

Specifically, one aspect of the present invention is a shot treatment apparatus that performs a shot treatment by ejecting shot material, together with compressed air, towards a treatment target, where "shot material" means blasting abrasives or peening media. This shot treatment apparatus is provided with a storage portion, a nozzle, a transport path, a compressed-air supply portion, a negative pressure gauge, an abnormality detection unit, an abnormality response unit, and a control unit. The storage unit stores the shot material. The nozzle sucks in the shot material by means of negative pressure generated in the interior thereof and ejects the shot material together with compressed air. The transport path transports the shot material from the storage portion to the nozzle. The compressed-air supply portion comprises a compressed-air supply portion that supplies compressed air to the nozzle. The negative pressure gauge detects negative pressure on the transport path. The abnormality detection unit detects "operational abnormalities" and "signs of operational abnormalities" based on a detection result from the negative pressure gauge. The abnormality response unit operates based on the detection result from the abnormality detection unit. The control unit controls an operation of this abnormality response unit.

According to this configuration, it is possible detect operational abnormalities and signs of operational abnormalities in the shot treatment apparatus, and to quickly respond to the operational abnormalities and signs of operational abnormalities.

In an embodiment of the present invention, the abnormality response unit comprises a warning mechanism that issues a warning including a warning display or a warning sound based on the detection result from the abnormality detection unit.

According to this configuration, when operational abnormalities or signs of operational abnormalities occur in the shot treatment apparatus, it is possible to be informed of said operational abnormalities or signs of operational abnormalities by means of the warning display or the warning sound. Thus, it is possible to quickly respond to the operational abnormalities or signs of operational abnormalities.

In an embodiment of the present invention, the abnormality response unit comprises an unclogging mechanism that supplies the compressed air to the transport path based on the detection result detected by the abnormality detection unit.

According to this configuration, it is possible to take preventive measures before the transport path becomes clogged by the shot material.

In an embodiment of the present invention, the unclogging mechanism comprises a three-way valve that receives the compressed air and that selectively supplies the compressed air to the nozzle or to the transport path.

According to this configuration, it is possible to inexpensively and conveniently form the unclogging mechanism.

In an embodiment of the present invention, the three-way valve comprises a first three-way valve that selectively supplies compressed air to the nozzle or to the transport path; and a second three-way valve that is located between the first three-way valve and the transport path, and that receives the compressed air from the first three-way valve, and selectively supplies the compressed air to the transport path or opens the transport path to atmospheric pressure.

According to this configuration, it is possible to inexpensively and simply form the unclogging mechanism because one end of the transport path can be closed and compressed air for preventing clogging can be supplied.

In an embodiment of the present invention, a plurality of the negative pressure gauges are provided on the transport path. In this case, the direction in which the negative pressure gauges are provided is in the direction of extension of the transport path.

According to this configuration, it is possible to respond quickly to abnormal situations because the locations at which clogs (or signs of clogs) of the shot material have occurred can be conveniently detected.

In an embodiment of the present invention, at least one of the negative pressure gauges is provided near a joint portion between the transport path and the nozzle.

According to this configuration, since there is a relatively high probability that the shot material will become clogged near a joint portion between the transport path and the nozzle, the location at which a clog occurs can be more precisely identified by providing a negative pressure gauge at this position.

In an embodiment of the present invention, at least one of the negative pressure gauges is provided near a joint portion between the storage portion and the transport path.

According to this configuration, since there is a relatively high probability that the shot material will become clogged near a joint portion between the storage portion and the transport path, the location at which a clog occurs can be more precisely identified by providing a negative pressure gauge at this position.

In an embodiment of the present invention, at least one of the negative pressure gauges is provided between the joint portion between the transport path and the nozzle, and the joint portion between the storage portion and the transport path.

According to this configuration, since the airtight seal in the transport path can be broken by tears, cracks, openings, or the like that are formed by the shot material abrading the transport path, the location at which a tear, a crack or an opening is formed can be more precisely identified by providing a negative pressure gauge on the transport path.

Another aspect of the present invention is a shot treatment method wherein a shot treatment is performed by ejecting shot material, together with compressed air, towards a treatment target. This shot treatment method comprises the steps (1) to (5) below:

(1) generating negative pressure in an interior of a nozzle from which the shot material is to be ejected together with the compressed air;

(2) transporting the shot material, by means of the negative pressure, from a storage portion in which the shot material is stored to the nozzle, through a transport path for conveying the shot material;

(3) performing a shot treatment by ejecting the transported shot material, together with the compressed air, towards the treatment target;

(4) detecting negative pressure in the transport path; and (5) detecting an operational abnormality or a sign of an operational abnormality based on the negative pressure detection result.

According to this configuration, when operational abnormalities or signs of operational abnormalities occur in a shot treatment apparatus, it is possible to be informed of said operational abnormalities or signs of operational abnormalities. Thus, it is possible to quickly respond to the operational abnormalities or signs of operational abnormalities.

Advantageous Effects of Invention

According to the present invention, it is possible to provide a shot treatment apparatus and a shot treatment method that can quickly and efficiently detect operational abnormalities or signs of operational abnormalities, and that can take countermeasures.

DESCRIPTION OF EMBODIMENTS

Figure 1:
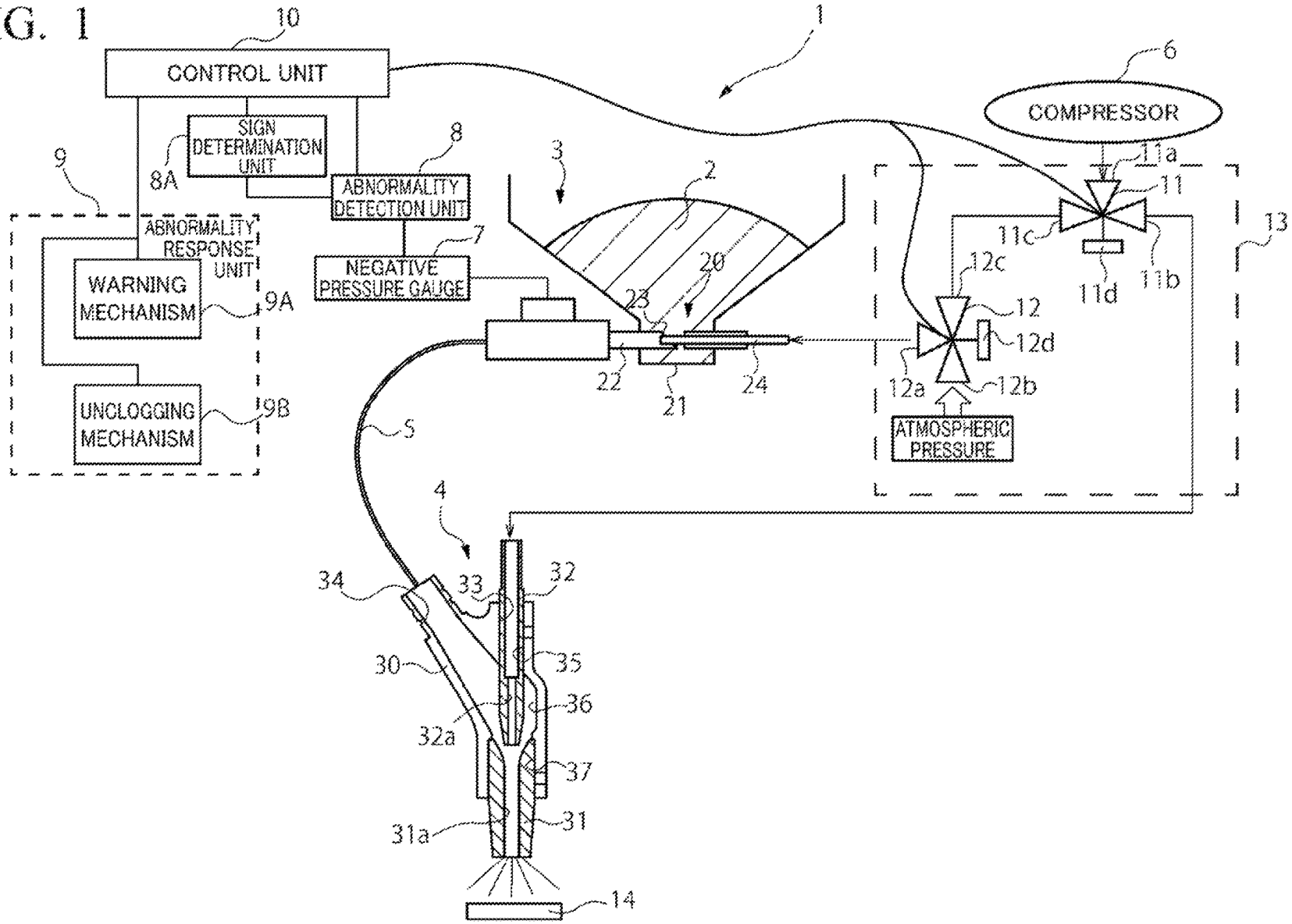
FIG. 1 is a schematic configuration view of a shot treatment apparatus according to a first embodiment of the present invention.

Hereinafter, embodiments of the present invention will be described in detail with reference to the drawings. In the descriptions below, "up, down, left and right" refer to the directions in the drawings, unless specially noted otherwise.

First Embodiment

An example of an embodiment of the present invention will be indicated below. FIG. 1 is a schematic configuration view of a shot treatment apparatus 1 according to an embodiment of the present invention. The shot treatment apparatus 1 comprises a hopper 3 (storage portion) that stores shot material 2, a hose 5 (transport path) that transports the shot material 2 from the hopper 3 to a nozzle 4, a compressor 6 (compressed-air supply portion) that supplies compressed air through the hose 5 to the nozzle 4, the nozzle 4 that ejects the shot material 2 by means of the compressed air, a negative pressure gauge 7 that detects the pressure in the hose 5, three-way valves (first three-way valve 11 and second three-way valve 12) that switch the flow route of the compressed air, and a control unit 10 that performs overall ejection control of the shot material 2.

The hopper 3 is a funnel-shaped component having a large opening in an upper end portion and a small opening in a lower end portion.

The hopper 3 stores shot material 2 in the interior thereof. An end portion 23 of a pipe 22 is disposed at the lower end portion 21 of the hopper 3, and a pipe 24 is disposed on a side facing the pipe 22. The pipe 22 and the pipe 24 form a shot material feeding apparatus 20.

Figure 2:
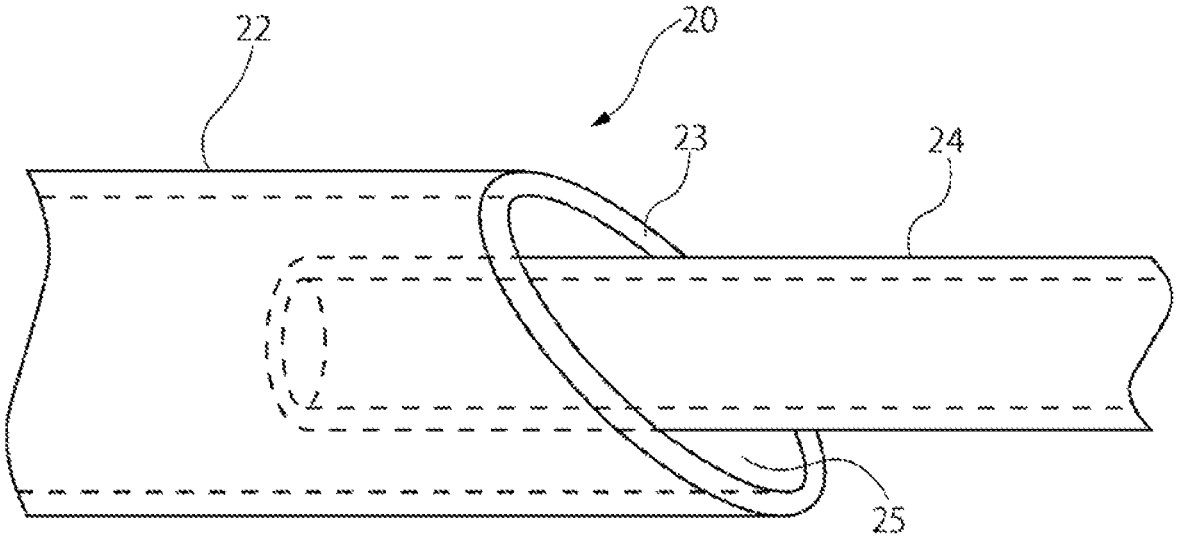
FIG. 2 is an enlarged perspective view illustrating a portion of a shot material feeding apparatus in the shot treatment apparatus.

As illustrated in FIG. 2, the pipe 24 is disposed inside the distal end portion 23 of the pipe 22. One end of the hose 5 is coupled to the pipe 22 outside the lower end portion 21 of the hopper 3, and the other end of this hose 5 is coupled to the nozzle 4.

The nozzle 4 is a so-called suction-type nozzle. The nozzle 4 comprises a nozzle body 30, a nozzle tip 31 and an air jet nozzle 32. A hole into which the nozzle tip 31 is inserted and fixed is formed in an upper end surface of the nozzle body 30, and a hole into which the air jet nozzle 32 is inserted and fixed is formed in a lower end surface. Additionally, the nozzle body 30 has, in the interior thereof, a main-body conduit 33 that provides communication between the nozzle tip 31 and the air jet nozzle 32, which are respectively inserted and fixed. Additionally, the nozzle body 30 has a shot material introduction conduit 34 that intersects the main-body conduit 33 from the side and at an angle, in a diagonal direction. The shot material introduction conduit 34 is connected to the hopper 3 via the hose 5 and the shot feeding apparatus 20. Additionally, the air jet nozzle 32 is coupled to the compressor 6 by a pipe. (See FIG. 1.)

The three-way valves comprise two three-way valves, namely, the first three-way valve 11 and the second three-way valve 12. The first three-way valve 11 and the second three-way valve 12 are both similar metallic fluid flow components.

There are one inlet and two outlets for a fluid (compressed air in the present embodiment). A switching valve is contained in the central interior. The switching valve is a cross-shaped or star-shaped fluid switching means that can switch air or the like that has entered through the inlet so as to be able to exit through either of the two outlets.

A first connection port 11*a* of the first three-way valve 11 is connected to the compressor 6, and a second connection port 11*b* is connected to the air jet nozzle 32 of the nozzle 4.

A first connection port 12*a* of the second three-way valve 12 is connected to a small-diameter pipe 24 provided at the lower end portion 21 of the hopper 3, and the second connection port 12*b* is open to the outside (atmospheric pressure). A third connection port 11*c* of the first three-way valve 11 is connected to a third connection port 12*c* of the second three-way valve 12.

These three-way valves 11, 12 are configured so as to be able to switch between a state in which the first connection ports 11*a*, 12*a* are in communication with the second connection ports 11*b*, 12*b*, and a state in which the first connection ports 11*a*, 12*a* are in communication with the third connection ports 11*c*, 12*c*, by operating levers 11*d*, 12*d*, or by means of commands from the control unit 10.

The negative pressure gauge 7 is a type of measuring instrument comprising a meter body and a pressure sensor, which are not illustrated. Although the present invention can be more favorably implemented by using an electrical negative pressure gauge, there is no limitation thereto. A mechanical negative pressure gauge is of a type such that negative pressure (suction pressure) is directly drawn to the pressure sensor, which is integrated with the meter body, and the negative pressure is detected by the pressure sensor and displayed on the meter body.

Meanwhile, an electrical negative pressure gauge is of a type such that suction pressure is detected by the pressure sensor and converted to an electrical signal by a conversion unit that is not illustrated, and the negative pressure (suction pressure) converted to an electrical signal is displayed on an electrical meter.

The negative pressure gauge 7 is primarily provided near a joint portion of the hose 5 with the hopper 3, near a bent portion of the hose 5, or near a joint portion of the hose 5 with the nozzle 4, is electrically connected to the control unit 10 described below, and successively transmits the detected negative pressure (suction pressure) information.

The control unit 10 is composed of a CPU, a memory device, a connector, a buffer, and the like, which are not illustrated, and is an area on a control substrate that integrally controls the individual functional processing parts indicated below.

The control substrate is included in a device for controlling the operations of the shot treatment apparatus such as a motion controller such as a programmable logic controller (PLC) or a digital signal processor (DSP), or various types of computation devices such as a personal computer (PC).

The control unit 10 is mainly formed from two functional areas, namely, an abnormality detection unit 8 and an abnormality response unit 9.

The abnormality detection unit 8 is an area in the aforementioned control unit 10, and is a functional processing part of the control unit 10 for electrically connecting to the above-mentioned negative pressure gauge 7, and detecting operational abnormalities or signs of operational abnormalities in the shot treatment apparatus 1 based on the detection results from this negative pressure gauge 7. The abnormality detection unit 8 comprises an IC chip and a memory device, a connector, a buffer, and the like. The aforementioned CPU stores programs and data necessary for computationally determining (comparing) what kinds of states are abnormal and what kinds of states are normal.

The abnormality response unit 9 is an area in the aforementioned control substrate 10, and is a functional processing part comprising an IC chip, a buffer, and the like, which are not illustrated. The abnormality response unit 9 contains a warning mechanism 9A and an unclogging mechanism 9B, which are described below. The IC chip stores programs and data necessary for controlling the warning mechanism 9A and the unclogging mechanism 9B.

The warning mechanism 9A is a functional processing part comprising a light blinking means such as a Patlite (registered trademark), an audio output means such as a speaker, a cable connecting the above, as well as a connector for connecting the cable to the aforementioned control substrate, a buffer, and the like.

The warning mechanism 9A issues a warning, including a warning display or a warning sound, indicating that the apparatus is abnormal, based on the detection results from the abnormality detection unit 9.

The unclogging mechanism 9B is a functional processing part that comprises an IC chip, a memory device, and the like, and that controls the compressed-air supply mechanism described below. When the shot material 2 becomes clogged in the hose 5 for the shot material 2 as described below, the unclogging mechanism 9B supplies compressed air to the hose 5, thereby unclogging the shot material.

A sign determination unit 8A is an area in the aforementioned control substrate, and is a functional processing part comprising an IC chip and a connector, a buffer, and the like. This IC chip stores programs or data necessary for the aforementioned CPU to computationally determine (compare) whether or not a current negative pressure value is a sign of an abnormal state.

The sign determination unit 8A determines signs that the shot material has clogged the hose 5, as described below, based on the detection results from the abnormality detection unit 8.

Figure 3:
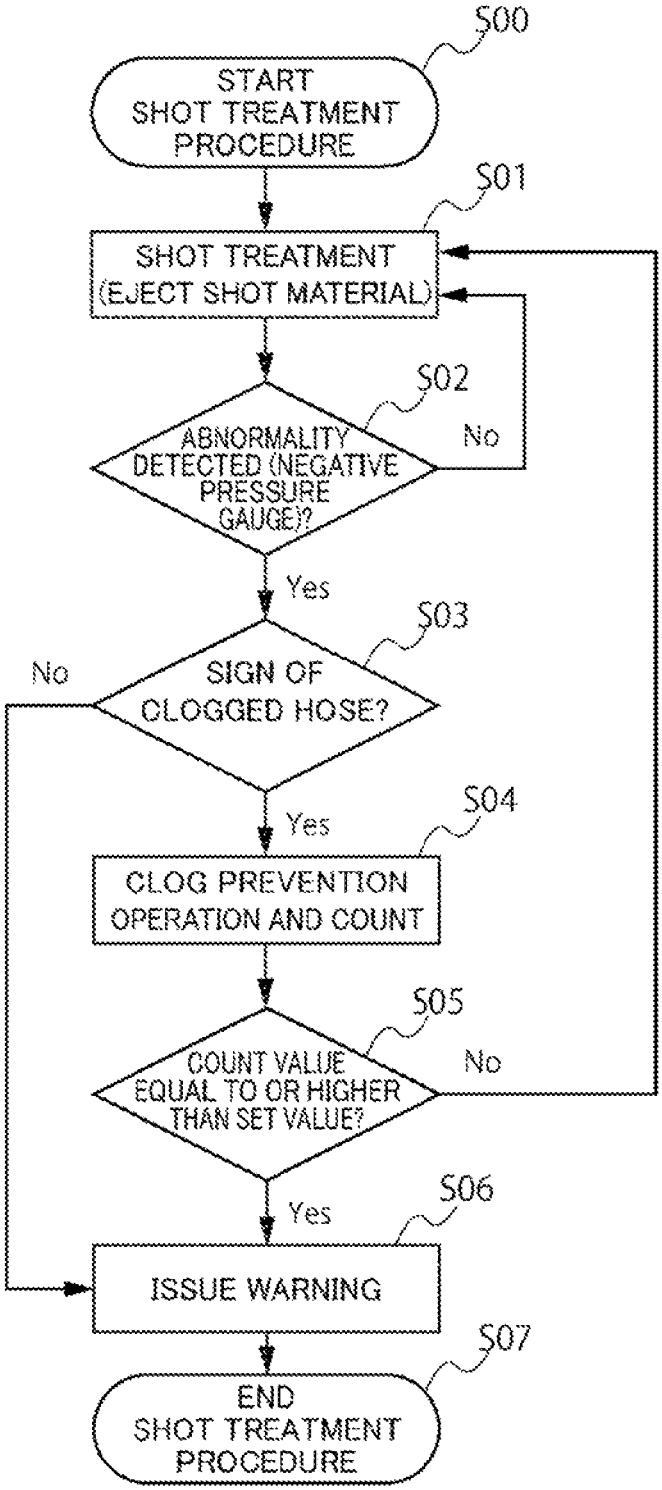
FIG. 3 is a flow chart for explaining operations in the shot treatment apparatus in the first embodiment of the present invention.

Next, the operations performed by the shot treatment apparatus 1 of the present embodiment will be explained with reference to FIG. 3. FIG. 3 is a flow chart for explaining the operations in the present embodiment.

In an initial state, the compressor 6 in the shot treatment apparatus 1 is at rest. The first three-way valve provides communication between the first connection port 11*a* and the second connection port 11*b*. The second three-way valve provides communication between the first connection port 12*a* and the second connection port 12*b*. A pipe 24 inserted into the lower end portion 21 of the hopper 3 is open to atmospheric pressure.

When the shot treatment procedure starts (S00), the compressor 6 is started and compressed air is fed through the first three-way valve 11 to the nozzle 4. This compressed air is supplied to the air jet nozzle 32 in the nozzle 4, and from the distal end thereof, passes through the nozzle tip 31 and is blown to the outside of the nozzle 4.

In this case, the compressed air that is ejected from the air jet nozzle 32, which has a small inner radius r3, is introduced through a central enlarged-diameter portion 36 having a large inner radius r2 and into the nozzle tip 31 having a small inner radius r1. For this reason, the inside of the central enlarged-diameter portion 36 enters a negative pressure state due to the Venturi effect.

As a result thereof, a negative pressure is generated in the shot material introduction conduit 34 and the hose 5. Due to this negative pressure, the shot material 2 is sucked, together with air from the pipe 24, which is open to atmospheric pressure, through a gap 25 between the pipe 24 and the end portion 23 of the pipe 22 shown in FIG. 2.

The shot material 2 that has been sucked in is transported through the hose 5 to the nozzle 4. The transported shot material 2 passes through the shot material introduction conduit 34 of the nozzle body 30, is mixed with the compressed air that is blown out from the distal end of the air jet nozzle 32 in the central enlarged-diameter portion 36, and begins to be ejected from the distal end of the nozzle tip 31 towards the treatment target 14.

Thereafter, the treatment by means of the shot material 2 involves the treatment target 14 being subjected to successive shot treatments by turning a pinch valve (not illustrated) provided midway between the three-way valve 11 and the nozzle 4 on and off (S01).

The negative pressure gauge 7 detects negative pressure in the hose 5. This detection data is transmitted to the abnormality detection unit 8, and it is determined whether or not an operational abnormality or a sign of an operational abnormality has occurred in the apparatus based on the negative pressure state as described below (S02).

If an operational abnormality or a sign of an operational abnormality is not detected (condition in S02: No), then the ejection of the shot material is continued (S01). If an operational abnormality or a sign of an operational abnormality is detected (condition in S02: Yes), then it is further determined, from the negative pressure state described below, whether or not this operational abnormality or sign of an operational abnormality is a sign of a clogged hose (S03).

If this operational abnormality or sign of an operational abnormality is not a sign of a clogged hose 5 (condition in S03: No), then the abnormality detection unit 8 sends the warning unit 9 a command to issue a warning, and the warning unit 9 issues a warning by means of a Patlite (registered trademark), a display, a sound, or the like (S06), and ends the series of steps by means of an action such as stopping the shot treatment apparatus 1 (S07).

If this operational abnormality or sign of an operational abnormality is a sign of a clogged hose 5 (condition in S03: Yes), then the abnormality detection unit 8 sends the control unit 10 a command to perform a clog prevention operation.

The control unit 10 drives the unclogging mechanism 9B and performs an operation to supply compressed air into the hose 5. This operation is implemented by switching the communication state of the first three-way valve 11 and the second three-way valve 12 in the compressed-air supply mechanism 13 forming a portion of the unclogging mechanism 9B, by means of commands from the control unit 10.

In other words, the first three-way valve is switched from a state of communication between the first connection port 11*a* and the second connection port 11*b* to a state of communication between the first connection port 11*a* and the third connection port 11*c*. As a result thereof, the compressed air from the compressor 6 that was being fed to the nozzle 4 enters a state in which the compressed air can be delivered to the second three-way valve.

The second three-way valve is switched from a state of communication between the first connection port 12*a* and the second connection port 12*b* to a state of communication between the first connection port 12*a* and the third connection port 12*c*.

As a result thereof, the compressed air fed from the first three-way valve 11 passes through the pipe 24 and the pipe 23, and is supplied to the hose 5. After a set period of time has passed, the communication state between the first three-way valve 11 and the second three-way valve 12 is returned to the initial state.

The compressed air that was supplied to the hose 5 is stopped, a counter (not illustrated) provided in the control unit performs a count, and the clog prevention operation ends (S04).

After the operations described above, the abnormality detection unit 8 determines whether or not the aforementioned count value is equal to or higher than a set value (S05). If the count value is less than the set value (condition in S05: No), then the shot material ejection process is continued (S01). If the count value is equal to or higher than the set value (condition in S05: Yes), then the warning unit 9 is sent a command to issue a warning, and the warning unit 9 issues a warning by means of a Patlite (registered trademark), a display, a sound, or the like (S06), and ends the series of steps by means of an action such as stopping the shot treatment apparatus 1 (S07).

Next, the method for detecting operational abnormalities or signs of operational abnormalities in the shot treatment apparatus 1 based on the detection results from the negative pressure gauge 7 will be explained with reference to FIG. 4 and FIG. 5.

Operational abnormalities in the shot treatment apparatus 1 include:

(a) cases in which the hose 5 is clogged with shot material;

(b) cases in which a crack or a hole has been formed in the hose 5; and (c) cases in which the hose 5 has come loose from a connection portion, for example, a connection portion of the nozzle 4 or the pipe 22.

The cause of clogging of the shot material 2, in the majority of cases, is that the shot material 2 is used by being circulated, so that oils and water adhered to the workpiece (treatment target), moisture from the air, contaminants in the environment, and the like adhere to the shot material, as a result of which the fluidity of the shot material 2 is lowered and clogging occurs.

Additionally, it is known that the locations at which clogs occur include parts at which the flow direction of the shot material 2 changes, such as bent portions of the hose 5, connection portions between the hose 5 and the nozzle 4, and the like, and parts at which the inner diameter of the transport path of the shot material 2 changes. (Case (a) above.)

Additionally, the inner surface of the hose 5 can be scraped away and holes can be formed due to abrasion from the shot material 2 caused by long-term operation of the shot treatment apparatus 1.

Additionally, the hose 5 can vibrate due to the flow of the shot material 2, and the hose 5 can be cracked due to the localized concentration of such vibrations. The locations at which holes and cracks form include parts at which the flow direction of the shot material 2 changes, such as bent portions of the hose 5. (Case (b) above.)

Additionally, when the shot treatment apparatus 1 is operated, the hose 5 can vibrate due to the flow of the shot material 2, and the repetition of such vibrations can cause the hose 5 to come loose from the nozzle 4 and the like. (Case (c) above.)

Figure 4:
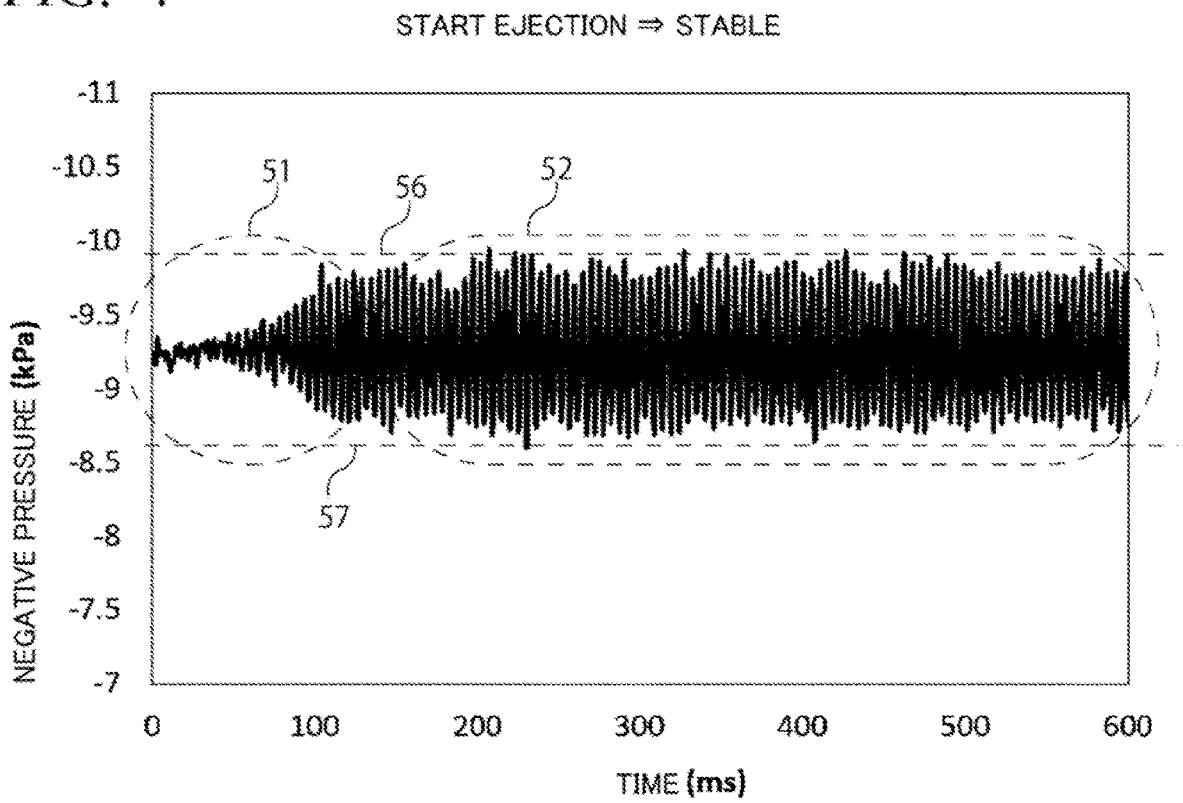
FIG. 4 is a graph indicating negative pressure values detected by a negative pressure gauge over time in an embodiment of the present invention.
Figure 5:
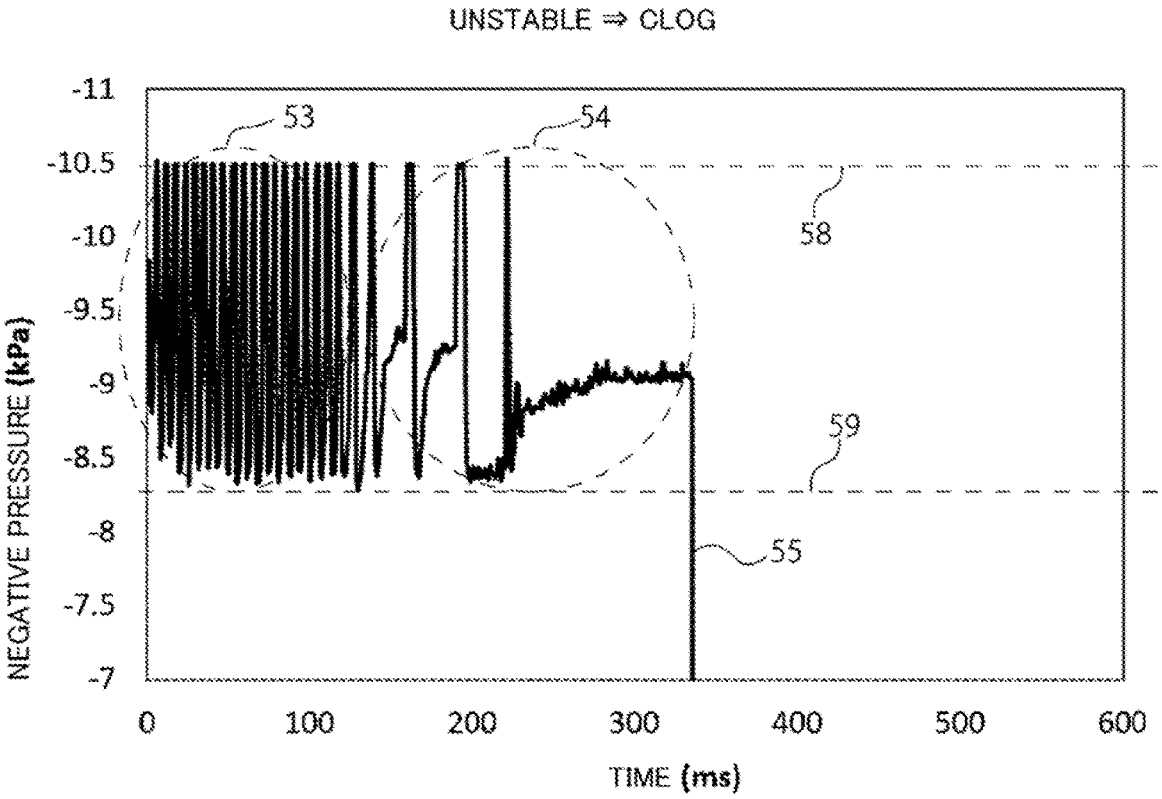
FIG. 5 is a graph indicating negative pressure values detected by a negative pressure gauge over time in an embodiment of the present invention.

FIG. 4 and FIG. 5 are negative pressure waveform graphs indicating the value of the negative pressure detected by the negative pressure gauge 7 over time.

FIG. 4 shows the waveform from the time at which the shot material 2 starts being ejected until the ejection becomes stable (dotted-line area 51), and in a state in which a stable state is continuing (dotted-line area 52).

FIG. 5 indicates a waveform from a stable-state negative pressure waveform (dotted-line area 53) until the operations become unstable (dotted-line area 54) and clogging 55 occurs.

It is known, from investigations carried out by the inventors of the present invention, that there is a tendency for the negative pressure in the hose 5 to be as indicated in Table 1 below.

TABLE 1

| State of Hose 5 | Specifics of Negative Pressure State in Hose 5 |
|---|---|
| (1) Ejection in empty state | Negative pressure is maintained (negative pressure −7 to −8 kPa). |
| (2) Shot material 2 flowing | Intermixture of shot material 2 reduces space inside the hose 5, raising negative pressure, except that the flow rate of the shot material 2 increases and decreases, thereby generating repeated pulses of "high negative-pressure states and low negative-pressure states" during ejection. |
| (3) Clogged | When the negative pressure (on the side towards the hopper 3) is measured by a negative pressure gauge 7, the air flow stops, so the pressure approaches atmospheric pressure (near negative pressure 0 kPa). |
| (4) Hole opened in hose 5 | Atmospheric pressure is approached (near negative pressure 0 kPa). |

It can be understood that the state in which the ejection is stable (dotted-line areas 52, 53) in FIG. 4 and FIG. 5 is state (2) in Table 1. In order to detect this state by means of a waveform, for example, the negative pressure range in the stable state is determined as in the dotted lines 56 to 59 in FIG. 4 and FIG. 5, and states of oscillation within this range with a certain period width are detected and defined as the normal state.

When the value falls outside the range of the dotted lines 56 to 59 (55 in FIG. 5), then it is determined that an operational abnormality has occurred. In FIG. 5, a case in which the value crosses the dotted line 59 in the downward direction on the page is shown, but cases in which the values cross the dotted line 58 in the upward direction are also defined as operational abnormalities.

Additionally, a state in which the amplitude of the waveform is contained between the dotted lines 58, 59, but the period is irregular, unlike that in the normal state (dotted-line area 54 in FIG. 5), is considered to be an unstable state. Furthermore, it is defined that there are signs of hose clogging (signs of operational abnormalities), and this is used as a trigger for a clog prevention operation.

As described above, the shot treatment apparatus 1 in the present embodiment comprises a negative pressure gauge 7 that detects negative pressure in the hose 5, and detects operational abnormalities and signs of operational abnormalities based on the negative pressure detection results. Thus, operational abnormalities or signs of operational abnormalities can be identified and quickly detected.

Additionally, a warning unit 9 for issuing warnings in response to operational abnormalities or signs of operational abnormalities is provided. Thus, when there are operational abnormalities or signs of operational abnormalities, the shot treatment can be immediately stopped, thereby reducing shot treatment defects.

The abnormality detection unit 8 is able to detect signs of clogging (signs of operational abnormalities). Thus, changes over time and the like in the shot treatment apparatus 1 can be accurately recognized.

Additionally, due to the unclogging mechanism 9B, when signs of clogging have been detected, compressed air can be supplied to the hose 5 to take clog prevention measures for recovering from the half-clogged state.

A warning can be issued when clog prevention measures have been performed more than a set number of times, thereby allowing inspections to be performed at an appropriate timing before the shot treatment apparatus 1 becomes inoperable, and avoiding unstable states.

As explained above, the above-mentioned shot treatment apparatus 1 comprises a storage portion 3 that stores shot material 2, a nozzle 4 that ejects the shot material by sucking the shot material by means of negative pressure generated in the interior thereof and ejecting the shot material together with the compressed air, a hose 5 that transports the shot material 2 from the storage portion 3 to the nozzle 4, and a compressed-air supply portion 6 that supplies compressed air to the nozzle 4.

Furthermore, this shot treatment apparatus 1 may be configured to perform any of the operations below, or may be configured to perform a combination of these operations:

1. issuing a warning including a warning display or a warning sound when an operational abnormality or a sign of an operational abnormality is detected;
2. supplying compressed air to the hose 5 when the sign of the operational abnormality is a sign of clogging in the hose 5;

3. counting the number of times that compressed air has been supplied to the hose 5 and issuing a warning when this count value becomes equal to or higher than a set value; and 4. issuing a warning when the count value of cases in which operational abnormalities or signs of operational abnormalities are signs of clogging of the hose 5 becomes equal to or higher than a set value.

Modified Example of First Embodiment

Figure 6:
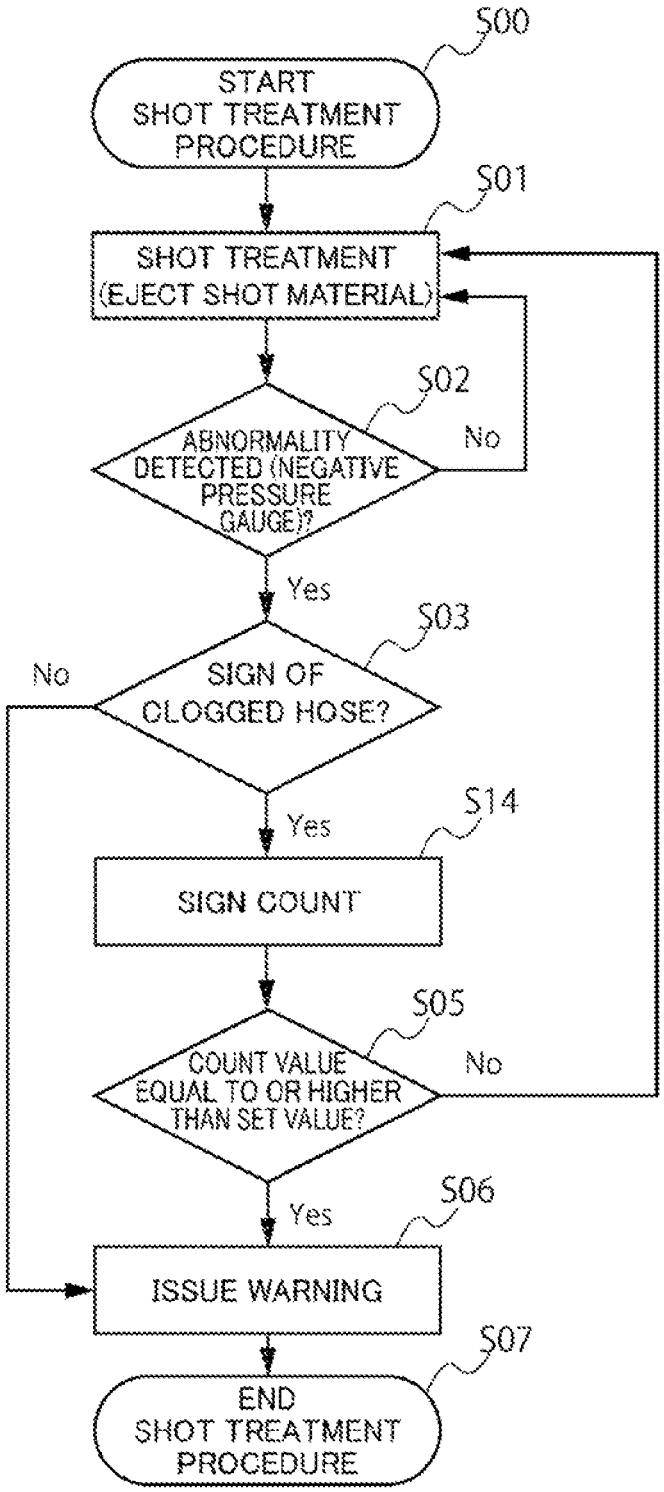
FIG. 6 is a flow chart for a modified example of an embodiment of the present invention.

Next, a modified example of the above-described first embodiment will be indicated below. FIG. 6 is a flow chart thereof. In FIG. 6, the steps that are the same as those in the flow chart in FIG. 3 are denoted by the same reference signs.

The difference between the present modified example and the above-described embodiment is that the clog prevention operation and the count (S04) in FIG. 3 are replaced by a sign count (S14). In other words, there are cases in which the signs of clogging (dotted-line area 54) indicated in FIG. 5 return to a stable state (dotted-line area 53) even when the aforementioned clog prevention operation for supplying compressed air to the hose 5 is not performed.

In this modified example, since there are cases in which signs of clogging and stable states occur successively and repeatedly, clog prevention operations are not performed, and control is implemented to issue a warning when the signs of clogging exceed a set number of times. By employing such a control method, the control can be simplified and the throughput of the treatment procedure can be improved. Additionally, an unclogging mechanism 9B does not need to be provided, and thus, the shot treatment apparatus 1 can be provided with a simple configuration.

Second Embodiment

Figure 7:
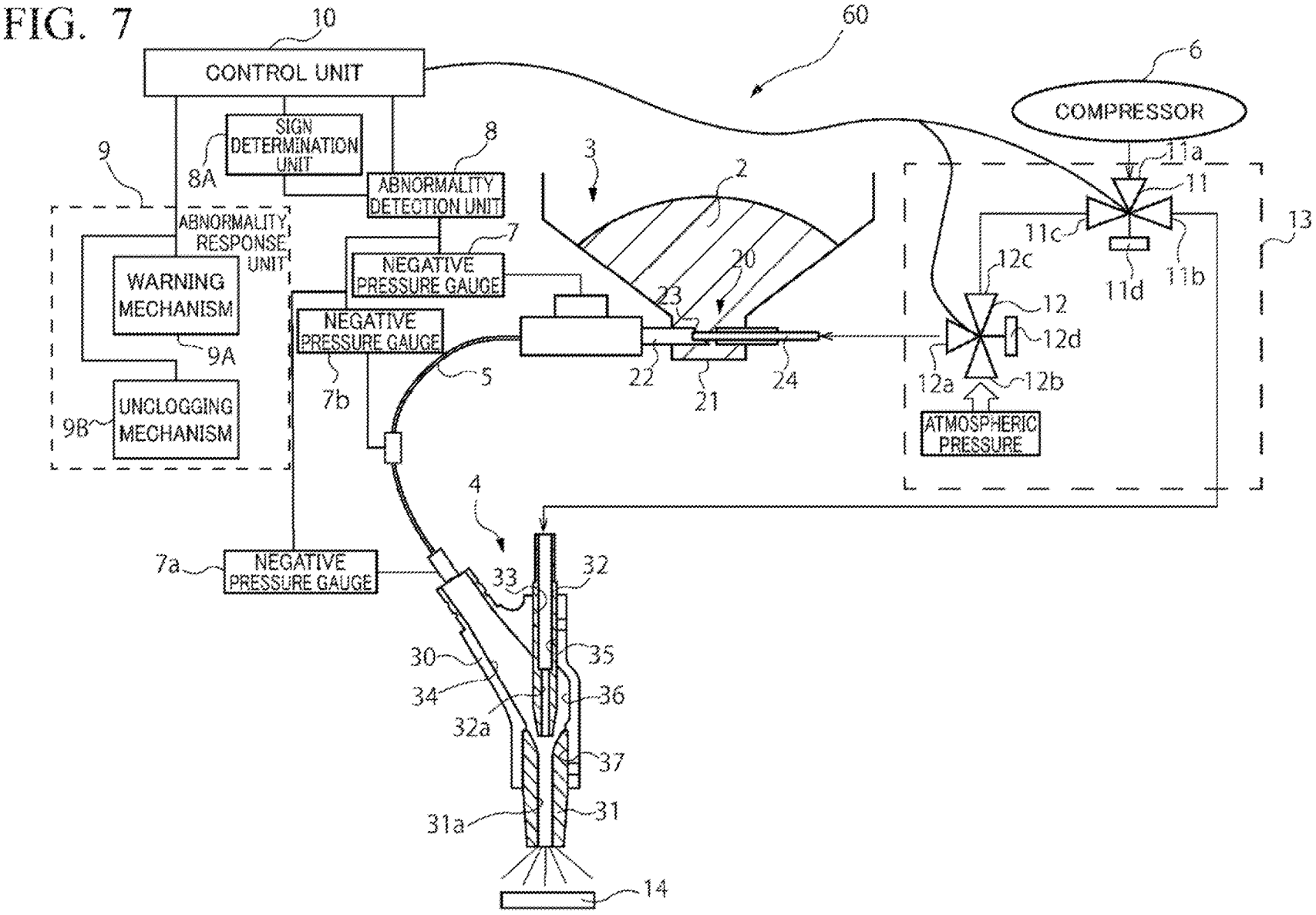
FIG. 7 is a schematic configuration view of a shot treatment apparatus according to a second embodiment of the present invention.

Next, a second example of an embodiment of the present invention will be indicated below. FIG. 7 is a schematic diagram of the shot treatment apparatus 60 according to the second example. In FIG. 7, the component elements that are the same as those in the first embodiment are denoted by the same reference signs.

The difference between this embodiment and the above-described first embodiment is that a negative pressure gauge 7*a* is provided near a joint portion of the hose 5 with the nozzle 4, and a negative pressure gauge 7*b* is provided at a bent portion of the hose 5 between the hopper 3 and the nozzle 4. The abnormality detection unit 8 is configured to analyze the values of the three negative pressure gauges 7, 7*a*, and 7*b* so as to assess operational abnormalities or signs of operational abnormalities.

By using such a configuration, it is possible to detect, in further detail, the location and state of operational defects in the hose 5. For example, if the values of the negative pressure gauges 7*a* and 7*b* stay high (−30 kPa or higher) and the value of the negative pressure gauge 7 is near atmospheric pressure (near 0 kPa), then it can be recognized that there is a clog in the hose 5 between the negative pressure gauge 7 and the negative pressure gauge 7*b*.

For example, if the values of all of the negative pressure gauges 7, 7*a*, and 7*b* are near atmospheric pressure (near 0 kPa), then it can be recognized that the hose 5 is in a state in which the airtight seal is broken, so a hole has formed in the hose 5 or the hose 5 has come loose from one of the connection portions. Therefore, information including more specific circumstances can be displayed, for example, on a display (not illustrated) of the warning unit 9, allowing countermeasures to the operational abnormalities and signs of operational abnormalities to be quickly performed.

The reason for providing the negative pressure gauge 7*b* in a bent portion of the hose 5 is because, at bent portions, the shot material 2 collides with the inner wall of the hose 5, so there is a tendency for wear to occur and for tears, cracks and openings to be relatively easily formed. Thus, by providing a negative pressure gauge at a bent portion of the hose 5, the locations at which tears, cracks and openings are formed can be more precisely identified.

Additionally, in the present embodiment, three negative pressure gauges are provided, but there is no limitation thereto, and the number of negative pressure gauges may be changed in accordance with the circumstances.

Supplemental Explanation of Embodiments

The shot treatment apparatus 1 of the above-described embodiments may be an apparatus for blasting or an apparatus for shot peening. Furthermore, the shot treatment apparatus 1 may be an apparatus for ejecting and causing collisions of the shot material 2 against a target surface to form a coating derived from the shot material 2.

The shot material 2 may, for example, be iron-based or non-iron metal-based shot, cut wire, and grit, ceramic particles (for example, alumina, silicon carbide, zirconium, or the like), glass particles, resin particles (for example, nylon resins, melamine resins, urea resins, or the like), particles obtained by grinding vegetable seeds (for example, walnuts, peaches, or the like), or the like, and the shot material 2 in the above-described embodiments is not particularly limited.

The embodiments described above are merely exemplary. The present invention is not limited to said embodiments, and includes equivalents and modifications that are covered by the technical concepts thereof.

REFERENCE SIGNS LIST

1, 60 Shot treatment apparatus
2 Shot material
3 Hopper (storage portion)
4 Nozzle
5 Hose (transport path)
6 Compressor (compressed-air supply portion)
7, 7*a*, 7*b* Negative pressure gauge
8 Abnormality detection unit
8A Sign determination unit
9 Abnormality response unit
9A Warning mechanism
9B Unclogging mechanism
10 Control unit
11 First three-way valve
12 Second three-way valve

The invention claimed is:

1. A shot treatment apparatus that performs a shot treatment by ejecting shot material, together with compressed air, towards a treatment target, the shot treatment apparatus comprising:

a storage portion that stores the shot material;

a nozzle that ejects the shot material, the nozzle sucking in the shot material by means of negative pressure generated in an interior thereof and ejecting the shot material together with the compressed air;

a transport path that transports the shot material from the storage portion to the nozzle;

a compressed-air supply portion that supplies the compressed air to the nozzle;

one negative pressure gauge that detects negative pressure in the transport path;

an abnormality detection unit that detects an operational abnormality or a sign of an operational abnormality based on a detection result from the negative pressure gauge;

an abnormality response unit that operates based on a detection result from the abnormality detection unit; and a control unit that controls an operation of the abnormality response unit.

2. The shot treatment apparatus according to claim 1, wherein the abnormality response unit comprises a warning mechanism that issues a warning including a warning display or a warning sound based on the detection result from the abnormality detection unit.

3. The shot treatment apparatus according to claim 1, wherein the abnormality response unit comprises an unclogging mechanism that supplies the compressed air to the transport path based on the detection result detected by the abnormality detection unit.

4. The shot treatment apparatus according to claim 3, wherein the unclogging mechanism comprises a three-way valve that receives the compressed air and that selectively supplies the compressed air to the nozzle or to the transport path.

5. The shot treatment apparatus according to claim 4, wherein the three-way valve comprises:

a first three-way valve that selectively supplies the compressed air to the nozzle or to the transport path; and a second three-way valve that is located between the first three-way valve and the transport path, and that receives the compressed air from the first three-way valve, and selectively supplies the compressed air to the transport path or opens the transport path to atmospheric pressure.

6. The shot treatment apparatus according to claim 1, wherein the negative pressure gauge is provided near a joint portion between the transport path and the nozzle.

7. The shot treatment apparatus according to claim 1, wherein the negative pressure gauge is provided near a joint portion between the storage portion and the transport path.

8. The shot treatment apparatus according to claim 1, wherein the negative pressure gauge is provided on the transport path located between the joint portion between the transport path and the nozzle, and the joint portion between the storage portion and the transport path.

* * * * *